US008459184B2

(12) United States Patent
Pisella et al.

(10) Patent No.: US 8,459,184 B2
(45) Date of Patent: Jun. 11, 2013

(54) SAFETY AND ARMING DEVICE FOR A PYROTECHNIC TRAIN OF A PROJECTILE

(75) Inventors: Christian Pisella, Beaucroissant (FR); Christophe Kergueris, Grenoble (FR); Laurent Reynard, Bourges (FR); Renaud Lafont, Bourges (FR); Pierre-Marie Visse, Meylan (FR)

(73) Assignee: Nexter Munitions, Versailles (FR)

( * ) Notice: Subject to any disclaimer, the term of this patent is extended or adjusted under 35 U.S.C. 154(b) by 6 days.

(21) Appl. No.: 13/358,642

(22) Filed: Jan. 26, 2012

(65) Prior Publication Data

US 2012/0192745 A1 Aug. 2, 2012

(30) Foreign Application Priority Data

Jan. 31, 2011 (FR) ..... 11 00311

(51) Int. Cl.
*F42C 15/26* (2006.01)

(52) U.S. Cl.
USPC ..... 102/235

(58) Field of Classification Search
USPC ..... 102/251, 247, 231, 233, 223, 221, 102/235
See application file for complete search history.

(56) References Cited

U.S. PATENT DOCUMENTS

| | | | | |
|---|---|---|---|---|
| 6,167,809 | B1 | 1/2001 | Robinson et al. | |
| 6,314,887 | B1 * | 11/2001 | Robinson | 102/262 |
| 6,568,329 | B1 | 5/2003 | Robinson | |
| 6,964,231 | B1 * | 11/2005 | Robinson et al. | 102/235 |
| 7,316,186 | B1 | 1/2008 | Robinson et al. | |
| 2009/0205526 | A1 * | 8/2009 | Lafont | 102/235 |

FOREIGN PATENT DOCUMENTS

EP 2 077 431 A2 7/2009

OTHER PUBLICATIONS

Sep. 20, 2011 French Search Report issued in French Patent Application No. 11.00311 (with English translation).

* cited by examiner

*Primary Examiner* — Stephen M Johnson
*Assistant Examiner* — John D Cooper
(74) *Attorney, Agent, or Firm* — Oliff & Berridge, PLC

(57) ABSTRACT

A micro-machined or micro-engraved safety and arming device for a pyrotechnic train of a projectile to which an axial spin motion is imparted during firing, the device includes a shutter to interrupt the pyrotechnic and being held immobile by at least two locks, a first lock or axial acceleration lock that is released further to the application of the acceleration during firing and a second lock that is a centrifugal lock released further to the spinning of the projectile.

10 Claims, 7 Drawing Sheets

SAFETY AND ARMING DEVICE FOR A PYROTECHNIC TRAIN OF A PROJECTILE

BACKGROUND OF THE INVENTION

1. Field of the Invention

The technical scope of the invention is that of safety and arming devices for a pyrotechnic train of a projectile and namely micro-machined safety and arming devices.

2. Description of the Related Art

Safety and arming devices (or DSAs) are well known. They generally incorporate a screen blocking a transmission channel which connects a detonator and a pyrotechnic charge.

The screen is thus positioned across the transmission channel of the detonic wave between the detonator and charge and it prevents the latter from functioning.

One of the problems encountered with classical devices is their volume. The parts are relatively massive to be able to ensure the interruption of the pyrotechnic train. Motor means enabling the screen to be displaced must therefore be powerful. More often than not it is springs that are used and which remain tensed during the storage phases, which can lead to the deterioration of their mechanical properties and to a loss of reliability of the armament.

For several years it has been proposed to manufacture all or part of safety and arming devices using chips incorporating micro-machined or micro-engraved electro-mechanical elements, either in an element deposited on a substrate, or directly on the substrate itself. This technology, known as MEMS (Micro Electra Mechanical System) enables micro-mechanisms to be manufactured implementing a technique similar to that used to produce electronic integrated circuits.

U.S. Pat. No. 6,964,231 discloses such a micro-machined safety and arming device incorporating a shutter carrying a pyrotechnic charge and sliding through the action of the centrifugal force. This shutter is itself immobilized by a lock that is retracted via the projectile's acceleration upon firing.

Another swiveling lock enables the shutter to be released and to be moved into its arming position through the centrifugal inertial force. The swiveling lock is activated by a gas-generating pyrotechnic composition whose ignition is controlled by electronic means.

Such as safety and arming device thus enables two independent environmental conditions to be exploited to ensure arming: the longitudinal firing acceleration and the centrifugal acceleration. This double safety enables this device to be compliant with the most stringent standards with respect to projectile arming safety (STANAG 4187).

It is however complex in structure and namely the second lock (swiveling lock) requires the implementation of a pyrotechnic composition and means to ignite it. Electronics must therefore be provided to activate the functioning of this MEMS, which is thus poorly adapted to use in medium caliber ammunition (caliber of less than 50 mm) in which there is limited available space.

Patent EP2077431 proposes a micro-machined safety and arming device in which arming is fully mechanical and fulfils the most stringent safety conditions, namely those requiring the presence of two independent environmental conditions in order to move into the armed position.

This safety device also suffers drawbacks, however.

It incorporates a centrifugal counterweight that ensures a lock is held in an indentation in the shutter. The retention of this lock by the counterweight during the full stroke of the latter generates friction which disturbs the counterweight's movement, and thus the delaying of the centrifugal arming operation.

SUMMARY OF THE INVENTION

The aim of the invention is to propose a micro-machined safety and arming device that does not suffer such a drawback. The device proposed by the invention enables the shutter to be released further to the displacement of a centrifugal counterweight but without the lock disturbing the movement of said counterweight.

Thus, the invention relates to a micro-machined or micro-engraved safety and arming device for a pyrotechnic train of a projectile to which an axial spin motion is imparted during firing, device comprising a substrate onto which a shutter to interrupt the pyrotechnic train is deposited that is mobile in translation on the substrate, device where the shutter to interrupt the train is held immobile by at least two locks, a first lock or axial acceleration lock that is released further to the application of the acceleration communicated to the projectile during firing and a second lock that is a centrifugal lock released further to the spinning of the projectile, device wherein the second lock comprises at least one swiveling locking finger positioned between the substrate and the shutter, finger oriented in a direction parallel to the direction of movement of the shutter and incorporating a bearing surface against which the shutter presses in its locked position, the finger further incorporating a prolongation, and the device incorporating a counterweight arranged in a housing in the shutter and sliding under the effect of the centrifugal acceleration until coming into contact at the end of its stroke with the prolongation of the finger to cause the latter to swivel and thus release the second lock.

Advantageously, the second lock incorporates two locking fingers symmetrical to one another and with respect to a median plane of the device parallel to the direction of movement of the shutter.

According to one embodiment, the prolongation of each finger extends inside the counterweight's housing, the counterweight further incorporating inclined planes that cooperate with the prolongations of the fingers to cause them to swivel.

According to another embodiment, each finger forms a right angle with its prolongation, the prolongation being near to the bottom of the cavity receiving the shutter on the substrate.

Each finger may be linked to the substrate by a pivot-type joint that will be positioned at the angle separating the finger and its prolongation.

Each joint can further be immobilized by breakable-type locking means that will be broken by the shutter pressing on them.

According to one variant, the device may incorporate shock-absorbing means comprising a flexible tongue integral with the substrate and against which the prolongations of the fingers will press when pushed by the counterweight at the end of its stroke.

According to another variant, each finger may be provided with a tooth at its end that presses on the counterweight in a safety position of the device, the counterweight further incorporating notches in which the teeth are housed when the counterweight causes the fingers to swivel.

BRIEF DESCRIPTION OF THE DRAWINGS

Other advantages will become apparent from the following description of different embodiment, description made with reference to the appended drawings, in which.

DETAILED DESCRIPTION OF PREFERRED EMBODIMENTS

Figure 1:
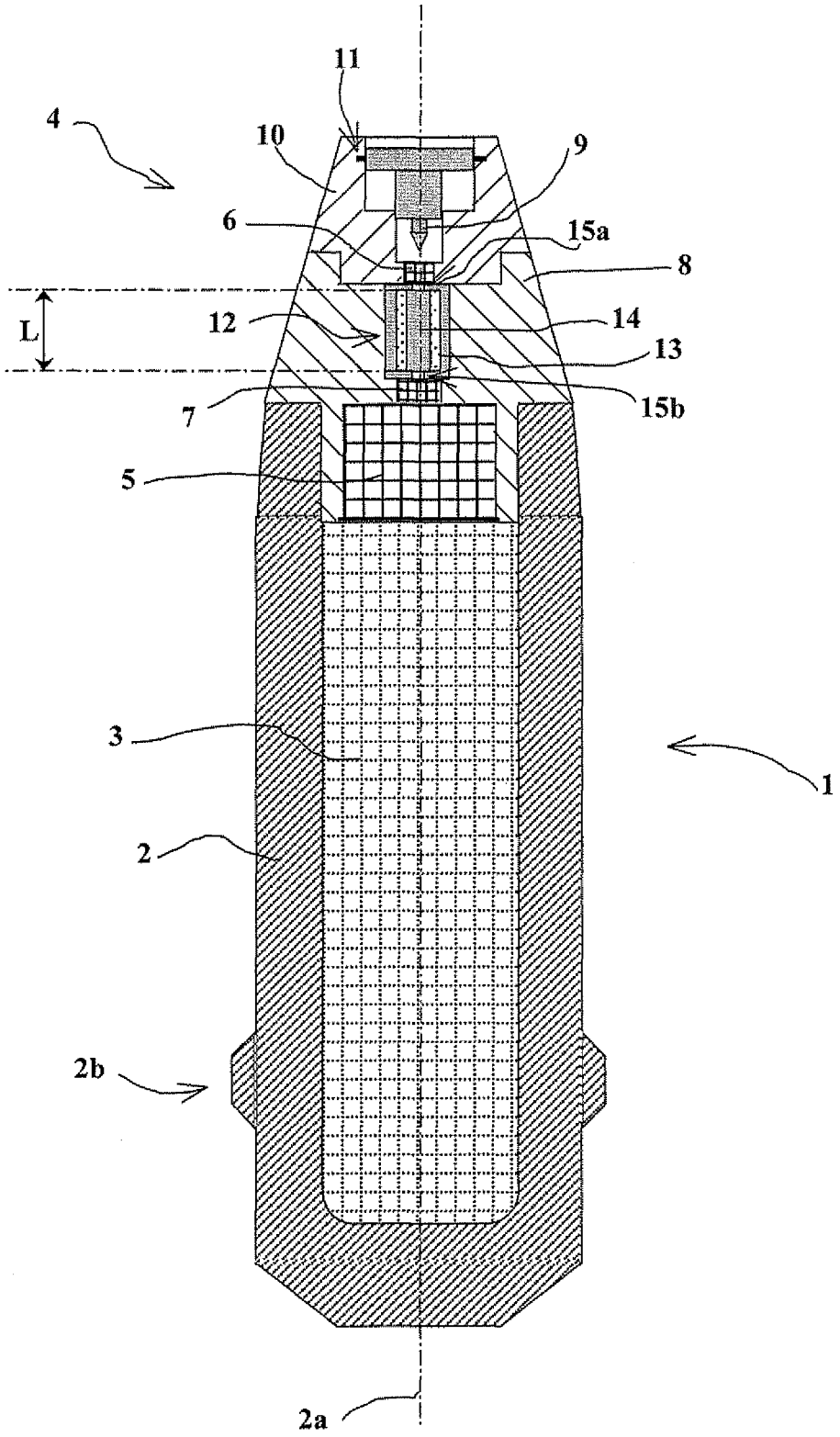
FIG. 1 is a schematic section view of a medium-caliber projectile equipped with a fuse incorporating the safety and arming device according to the invention.

FIG. 1 shows a medium-caliber projectile 1 (caliber of less than 50 mm) that incorporates a body 2 with axis 2*a* enclosing an explosive load 3. The body 2 receives a fuse 4 at its front part that is screwed into a threaded hole in the body 2. The fuse 4 comprises a case 8 enclosing a priming charge 5. The priming charge 5 is intended to be ignited by a pyrotechnic train comprising a detonator 6 and a relay 7 (alternatively, this relay 7 might be omitted and the detonator 6 will in this case ignite the priming charge 5 directly). The detonator 6 here is a percussion detonator ignited by a firing pin 9 mounted sliding in a nose 10 integral with the case 8 of the fuse 4. When the projectile 1 hits a target, the firing pin 9 is projected onto the detonator 6. The firing pin is held in position during the storage and firing phases by a shearable ring 11.

It is naturally possible for the device according to the invention to be implemented using an electrical detonator 6 controlled, for example, by electronic timing means or by a proximity detector.

The fuse 4 also encloses a safety and arming device 12 that enables the pyrotechnic train to be interrupted during the storage phase and at the onset of the projectile 1 firing phase.

In accordance with the invention, this safety and arming device is made in the form of a micro-machined or micro-engraved device (MEMS). It thus comprises a substrate 13 on which a shutter 14 is mounted sliding to ensure the interruption of the pyrotechnic train.

The substrate 13 incorporates two openings 15*a* and 15*b* arranged on either side of the shutter 14. The axis of these openings 15*a*, 15*b*, and thus the direction of action of the pyrotechnic train (6-7), is thus substantially parallel to the plane of the shutter 14. This axis is also the same as that of the axis 2*a* of the projectile.

Such an arrangement of a shutter to interrupt a pyrotechnic train such that the direction of the pyrotechnic train faces the thickness of the shutter 14 and is not perpendicular to the plane of the shutter (as in conventional MEMS devices) is known namely by patent EP1780496.

Reference can be made by a person skilled in the art to this patent which describes the general characteristics of such a priming train and the shutter associated with it.

It can be noted that the detonator 6 must be of the minimal size still enabling it to function and that it will be coupled with a suitable pyrotechnic relay 7 (or 5). It has been verified that by implementing a detonator incorporating an output stage of 10 milligrams of cyclonite coupled with a highly insensitive relay, for example of HNS (hexanitrostilbene), it was possible to make openings 15*a*, 15*b* (or transmission channels) with a section of less than 1 $mm^2$ (channel diameter of around one mm) whilst ensuring the required ignition transmission.

It is thus possible for the pyrotechnic effect to be interrupted using a silicon shutter with a length L or around 3 mm which can be easily produced using MEMS technology. This length of silicon of around 3 mm corresponds here to the dimension L of the shutter 14 referenced in FIGS. 1 and 2.

The projectile 1 is further equipped with a band 2*b* that slides in the rifling of the gun barrel (not shown) and imparts a spin motion to the projectile 1 around its axis 2*a* during firing.

FIG. 2 shows in greater detail the internal structure of a first embodiment of the safety and arming device 12 according to the invention.

The device comprises a substrate 13 on which a shutter 14 to interrupt the pyrotechnic train is positioned, such shutter being mobile in translation on the substrate in a cavity 31.

The shutter 14 is made by micro-machining or micro-engraving using MEMS techniques well known to one skilled in the art.

The Figures show the openings 15*a* and 15*b* arranged on either side of the shutter 14 as well as the axis 16 of these openings (thus the direction of action of the pyrotechnic train). The dimension L of the shutter 14 ensures the interruption of the pyrotechnic train in the device's 12 safety position.

The shutter 14 to interrupt the train is held immobile by two locks.

A first lock 17 (or axial acceleration lock) and a second lock 18 which is a centrifugal lock released further to the projectile's 1 spinning.

Figure 3:
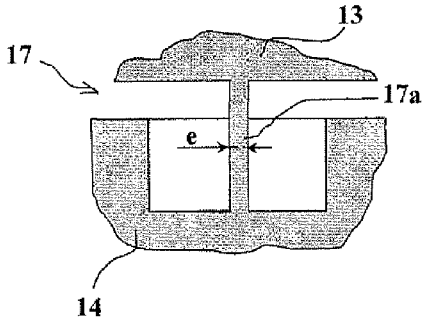
FIG. 3 is an enlarged view of one embodiment of the first lock.

The axial acceleration lock 17 is formed here by two breakable tongues which link the shutter 14 to the substrate ("breakable" tongues). FIG. 3 shows an enlarged view of one embodiment of such a tongue 17*a*. The tongues 17*a* supporting the shutter are oriented such that the axial inertial stresses exerted on the shutter 14 during the firing of the projectile will cause the tongues to fracture. Furthermore, the tongues 17*a* will be dimensioned such that this fracture will occur only as a result of inertial stresses due to firing and not during shocks received by the device during handling phase or else during logistic operations.

The width e of the tongue 17*a* will thus be calibrated to break during an acceleration of around 50,000 $m/s^2$, which is of the magnitude of the accelerations to which medium caliber projectile (caliber of less than or equal to 40 mm) are subjected.

Depending on the architecture of the device 12 the axial acceleration lock 17 may be made in the form of tongues stressed in traction, in compression or else shear stressed tongues, or a combination of several types of tongue.

The fact of making the first lock in the form of breakable tongues enables the device to be made more compact. It is no longer necessary for a specific locking mechanism to be made associating locks and return springs. The simplification of the mechanism also makes the device more reliable. This solution is particularly well adapted in the domain of medium-caliber projectile for which the operational reversibility of the device (return to the safety position) is not an issue.

According to an essential characteristic of the invention, the second lock 18 (or centrifugal lock) comprises at least one swiveling locking finger 18*a* that is positioned between the substrate 13 and the shutter 14.

More particularly, the second lock incorporates two locking fingers 18*a* symmetrical to one another and with respect to a median plane of the device parallel to the direction of movement 19 of the shutter 14.

Figure 2A:
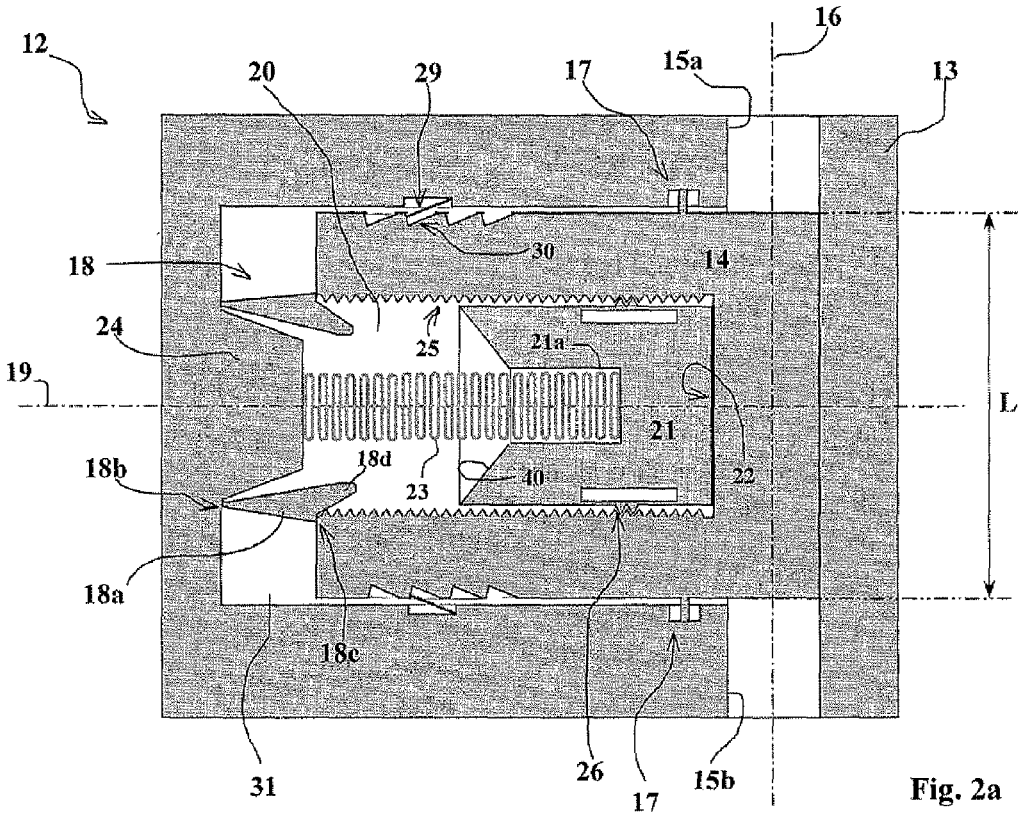
FIG. 2*a* is a view of a first embodiment of the safety and arming device according to the invention in its safety position.

Each finger 18*a* is substantially oriented in a direction parallel to the direction of movement 19 of the shutter 14. It incorporates a thinned end 18*b* linking it to the substrate and which constitutes a flexible link. The finger 18*a* incorporates a bearing surface 18*c* which forms a heel against which the shutter 14 presses in its locked position, as seen in FIG. 2*a*.

The finger 18*a* further incorporates a prolongation 18*d* which extends inside a housing 20 arranged inside the shutter 14.

The housing 20 receives a counterweight 21 sliding in this housing 20 under the effect of the centrifugal acceleration. The counterweight is held pressed against the bottom 22 of its housing by a compression spring 23, also micro-engraved, which links a stud 24 (integral with the substrate 13) and the counterweight 21.

As can be seen in the Figures, the spring 23 penetrates inside an internal chamber 21*a* in the counterweight 21.

As was already the case in patent EP2077431, the counterweight 21 moves in a direction D which is the same direction of movement as that of the shutter 14 and which is also a direction perpendicular to the direction of action 16 of the pyrotechnic train.

When the device is installed in a projectile, axis 19 thus corresponds to a radial direction of the projectile and the centrifugal inertia can be exerted on the counterweight 21 and the shutter 14. The integration of the device in a projectile is thus extremely simple despite the reduced dimensions of this device 12. Indeed, the pyrotechnic alignment of axis 16 necessarily leads to the correct orientation of the device with respect to the projectile.

Braking means are provided to slow down the displacement of the counterweight 21 and the shutter 14.

These means comprise reliefs or indentations 25 made in the walls of the housing 20 and parallel to direction 19. The indentations 25 cooperate with the matching reliefs or indentations 26 integral with the counterweight 21. The latter incorporates symmetrical indentations 26 on each of its faces in contact with the walls of the housing 20. Here, the indentations are triangular in profile. This profile may be of a different shape: rounded or rectangular.

Figure 4:
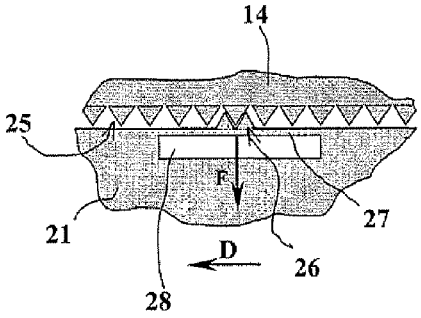
FIG. 4 is an enlarged view of means to slow down the displacement of the counterweight.

As may be better seen in FIG. 4, the indentations 26 integral with the counterweight 21 are carried by a flexible tongue 27 integral with the counterweight 21 and delimited by the engraving of an opening 28 in the counterweight 21.

When the counterweight 21 is displaced (arrow D) further to the action the inertial stresses associated with a centrifugal acceleration, the indentations 25 of the shutter push the indentations 26 of the counterweight 21. The resulting friction stress causes the tongue 27 to bend and push the indentations 26 away from those 25 of the shutter 14. The displacement of the counterweight is thus made possible thanks to the flexibility of the tongues 27 located on either side of the counterweight 21 whereas the play between the counterweight 21 and its housing 20 is reduced.

The indentations 25 of the shutter are in fact practically in contact with the lateral faces of the counterweight. Note that, with such reduced play, it would be impossible for the counterweight 21 to move in a zigzag (as for known devices). Furthermore, since the indentations on each lateral face of the counterweight are symmetrical, the displacement of the counterweight 21 is made in a straight line in the housing 20.

The friction induces braking and therefore delaying of the displacement of the counterweight 21.

This delaying of the displacement of the counterweight 21 slows down the retraction of the centrifugal locks 18. Muzzle safety is thus ensured during firing. The device 12 is only armed after having traveled a certain distance after exiting the gun barrel.

By way of a variant, and in a symmetrical manner, it would naturally be possible to make fixed indentations in the counterweight 21 and to provide indentations on the shutter 14 integral with a flexible tongue.

The functioning of this device will now be described with reference to FIGS. 2*a* to 2*c*.

FIG. 2*a* shows the device in its safety position, which is its position inside the gun barrel before firing.

As has been previously described, the firing acceleration causes the appearance of an axial inertial force that will cause the tongues 17*a* of the first lock to break, thereby releasing the shutter 14.

The shutter 14 is, however, still retained it its safety position by the centrifugal lock 18. Breakable locking strips may also be provided (not shown) which would prevent the displacement of the fingers 18*a* further to the axial accelerations during firing. These locking strips will be oriented so as to be broken by the displacement of the shutter 14 or the counterweight 21.

Figure 2B:
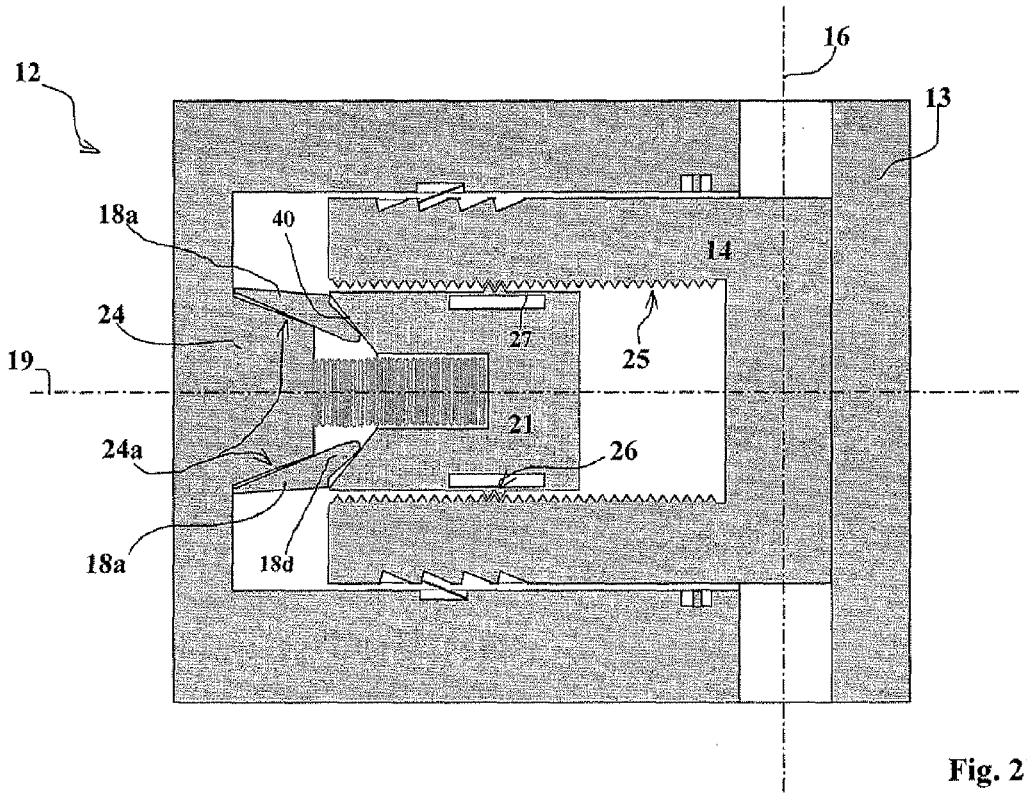
FIGS. 2*b* and 2*c* shows this same device during the different steps leading to its arming.

FIG. 2*b* shows the device in the position it adopts after exiting the gun barrel and at a distance of fifteen meters or so.

The centrifugal acceleration has induced the appearance of a radial inertial force which is exerted on the counterweight 21. The counterweight gradually moves away against the action of the second spring means 23 slowed down by the friction of the indentations 26 on the counterweight 21 on those 25 of the housing 20 in the shutter 14.

The stiffness of the spring means 23 and the braking means 25, 26, 27 are defined so as to delay the passage of the counterweight 21 to its unlocked position, such that the configuration according to FIG. 2*b* is only reached fifteen meters or so from the gun barrel. The number of indentations 26 carried by the counterweight 26, or the flexibility of the tongues 27, may namely be varied.

FIG. 2*b* shows that the counterweight 21 incorporates inclined planes 40 that cooperate with prolongations 18*d* of the fingers 18*a* to cause them to swivel towards the stud 24.

FIG. 2*b* shows that when the fingers 18*a* are pressing on the inclined lateral faces 24*a* of the stud 24, the counterweight 21 is immobilized. The spring 23 absorbs the shock of the counterweight 21 butting on the stud 24 by means of the fingers 18*a*.

Since the fingers 18*a* have swiveled, the shutter 14 is no longer locked and it then moves in direction 19 through the effect of the centrifugal inertial forces exerted upon it.

This displacement of the shutter is delayed thanks to the indentations 26 and 25, the flexibility of the tongues 27 enabling such a delayed displacement uses the same mechanism as that implemented for the displacement of the counterweight 21.

Figure 2C:
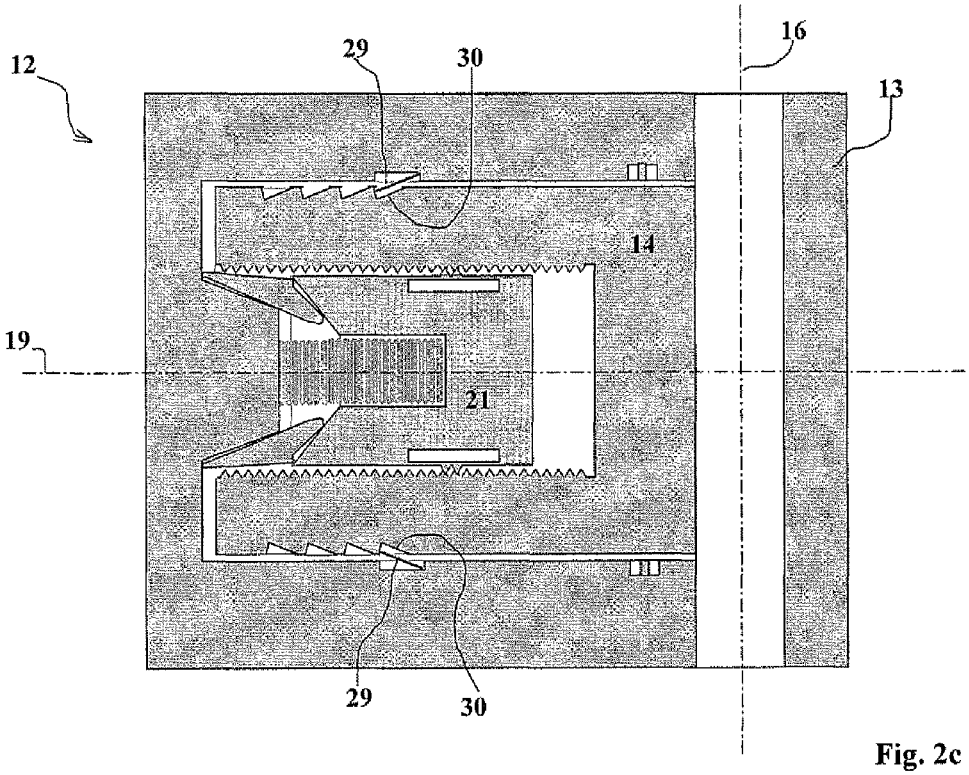

At the end of this movement, the shutter 14 adopts its unlocked position (FIG. 2*c*).

The shutter 14 no longer blocks the openings 15*a*, 15*b*. The direction of action 16 of the pyrotechnic train is thus freed and the device is in its armed position. An impact on a target will cause the ignition of the projectile's explosive load.

Note that the shutter 14 is locked into its armed position by the tongues 29 integral with the substrate 13 and which engage in notches 30 arranged on a lateral surface of the shutter 14 so as to prevent the latter from returning to its safety position.

As can be seen, the device according to the invention is extremely simple and takes up relatively little space. Its structure is fully mechanical and it can be incorporated into a medium-caliber projectile at a low cost.

Note also that the device according to the invention enables the displacement of the counterweight 21 (and thus a delay in arming) that is not disturbed by the friction on the shutter's locks. Indeed, the fingers 18*a* constituting these locks are only released after the full displacement of the counterweight.

Furthermore, the device according to the invention enables an arming delay to be defined that is long enough (fifteen microseconds or so) despite a relatively reduced stroke of movement of the shutter 14.

Figure 5A:
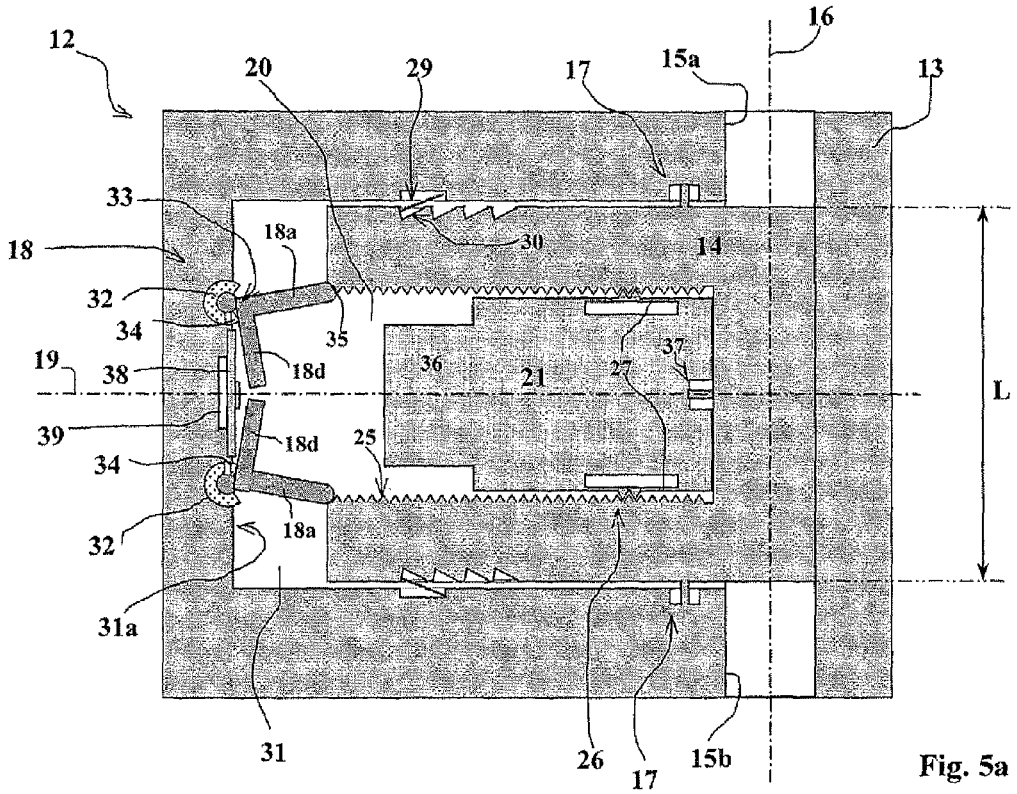
FIG. 5*a* is a view of a second embodiment of the safety and arming device according to the invention in its safety position.
Figure 5B:
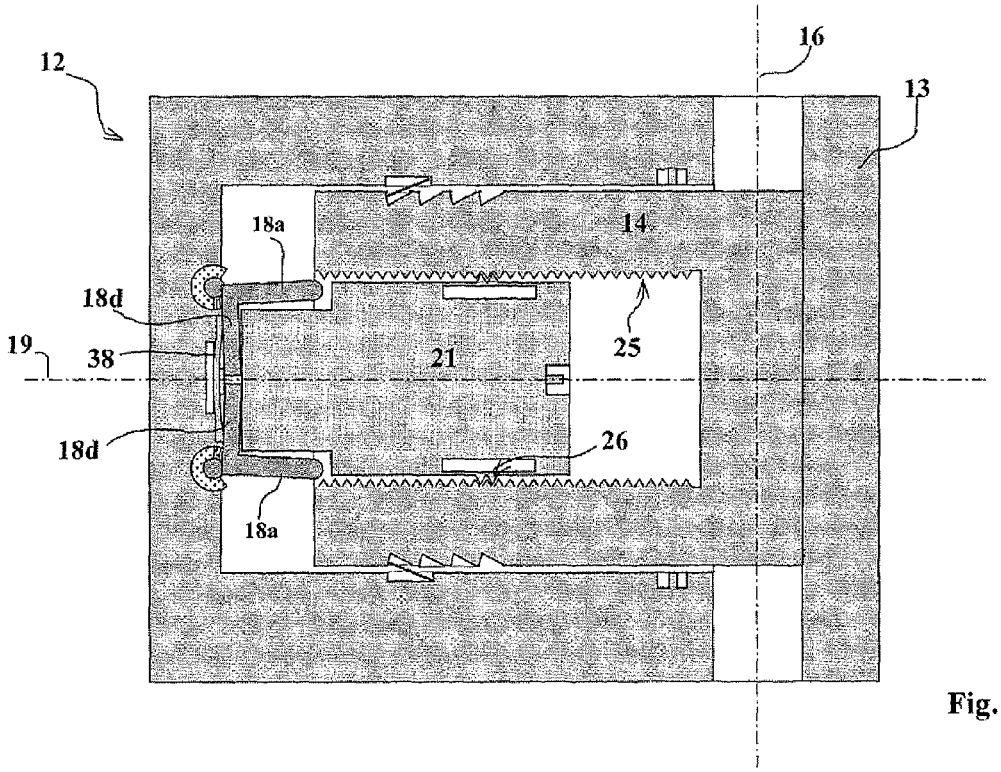
FIGS. 5*b* and 5*c* show this same device during the different steps leading to its arming.
Figure 5C:
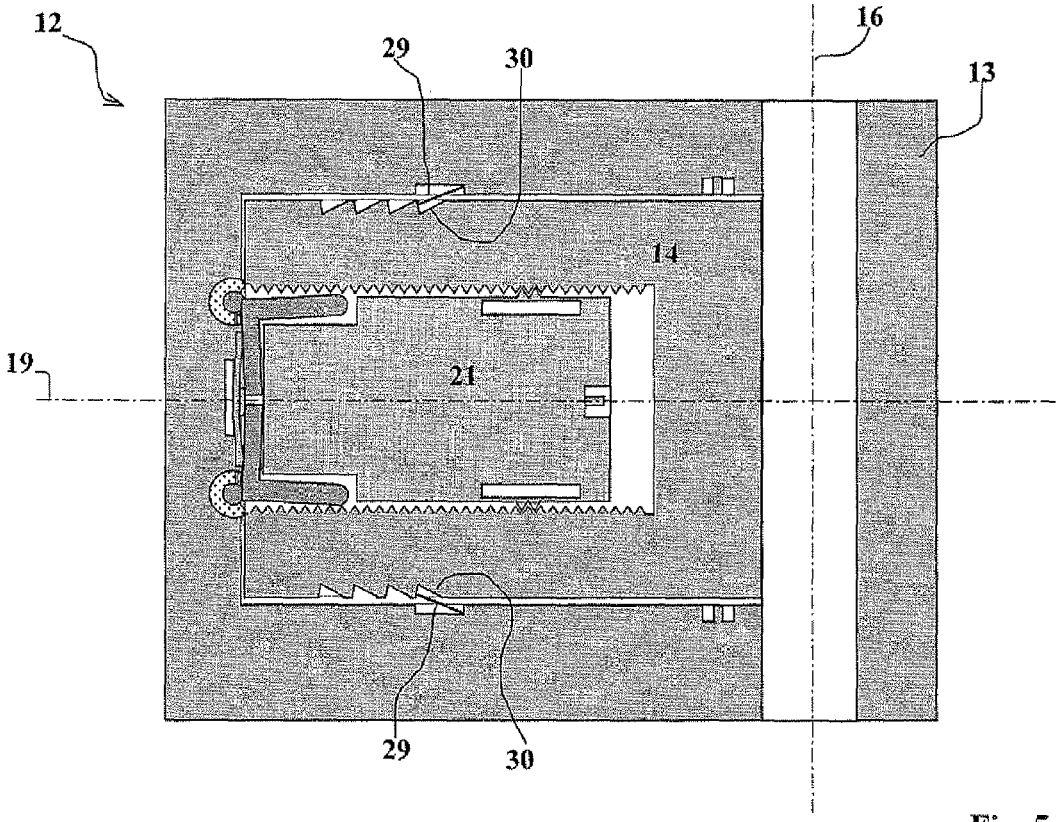

FIGS. 5*a* to 5*c* show a second embodiment of the device according to the invention.

This device differs from the previous one in the embodiment of the second lock 18. According to this embodiment, the lock comprises two locking fingers 18*a* which are substantially L-shaped. Each finger 18*a* thus forms a right angle with its prolongation 18*d*. Furthermore, the prolongation 18*d* is near to the bottom 31*a* of the cavity of the substrate 13 receiving the shutter 14.

Each finger 18*a* is linked to the substrate 13 by a pivot-type joint 32 positioned on the angle 33 separating the finger 18*a* and its prolongation 18*d*.

The joint 32 is naturally made by micro-machining or micro-engraving. This operation will be performed such as to leave a breakable bridge 34 that will act as locking means for the finger in question. This bridge will be broken when the shutter 14 presses against the fingers 18*a* under the effect of the centrifugal acceleration after the first lock 17 has broken.

FIG. 5*a* shows that the end of each finger 18*a* presses on a seat 35 arranged on the shutter 14. The shutter 14 is thus locked in translation by the fingers 18*a*.

As in the previous embodiment, the counterweight 21 incorporates indentations 26 on a flexible tongue 27 integral with the counterweight 21 and delimited by the engraving of an opening 28. These indentations 26 cooperate with the indentations 25 carried by the walls of housing 20 which are parallel to direction 19 in order to constitute braking means both for the displacement of the counterweight 21 and that of the shutter 14.

The front part 36 of the counterweight 21 intended to come into contact with the prolongations 18*d* of fingers 18*a* here are of reduced width. Such an arrangement enables the fingers 18*a* to be received between the counterweight 21 and shutter 14 when the latter takes up its armed position as seen in FIG. 5*c*.

It can be observed that, contrary to the previous embodiment, here there is no compression spring. Since the safety and arming device is irreversible, a return spring is unnecessary. The main function of the return spring was to absorb the shock of the counterweight 21 on the fingers 18*d* during arming. Here, the device is immobilized in its safety position by the stiffness of the tongues 27 which hold the indentations 26 inside indentations 25. Depending on the design constraints encountered, it will be possible for a breakable lock to be provided that is analogous in structure to that of inertial locks 17 but positioned between the counterweight 21 and the shutter 14. This lock will thus incorporate a tongue oriented so as to withstand the stresses linked to the axial acceleration and dimensioned to break for the acceleration level encountered for the projectile in question. By way of example, such a breakable lock 37 is shown in FIG. 5*a*.

To ensure the shock-absorbing function for the counterweight 21 specific means are provided that are constituted by a flexible tongue 38 that is micro-machined in the substrate 13 and delimited by a cavity 39.

The prolongations 18*d* of fingers 18*a* press against this tongue 38 when the counterweight 21 presses on them at the end of its stroke. The shock is absorbed and the tongue 38 exerts a return force that secures the position of the counterweight 21.

This device functions in an analogous manner to that described previously.

FIG. 5*a* shows the device in its safety position. FIG. 5*b* shows this device after the full displacement of the counterweight 21, thus after the delay ensured by the braking means 25, 26, 27 but before the displacement of the shutter 14.

FIG. 5*c* lastly shows the device in the unlocked position after the displacement of the shutter 14.

Figure 6A:
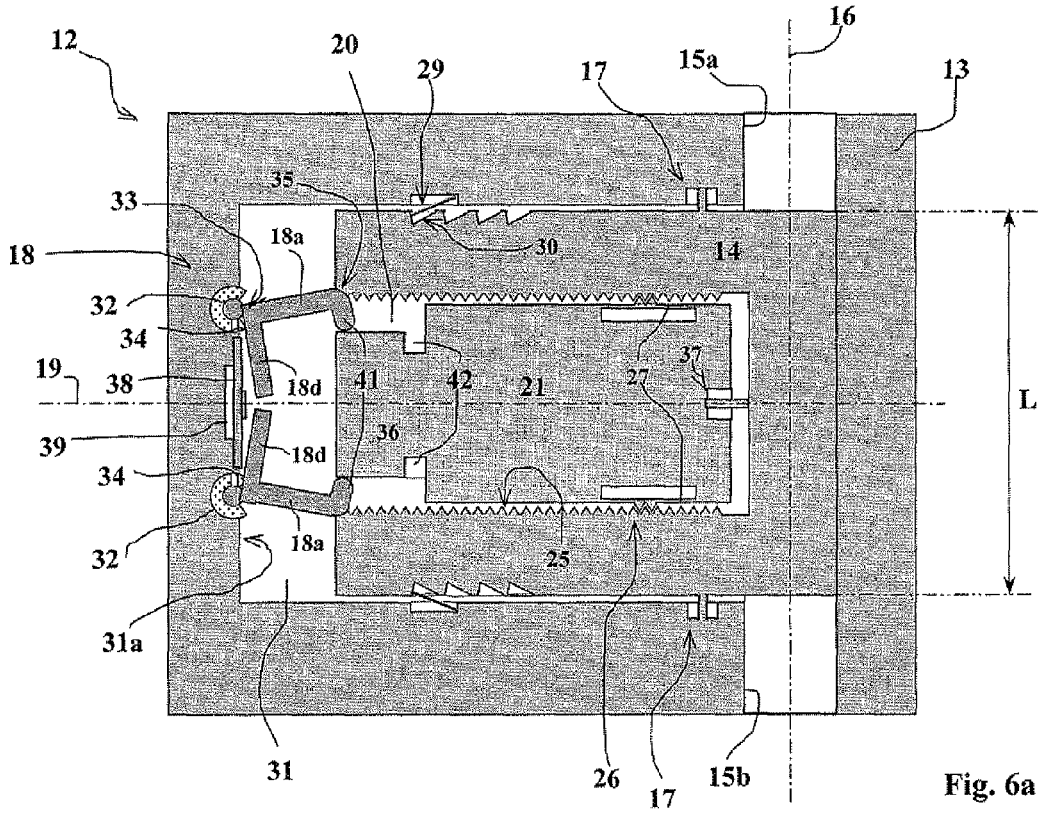
FIG. 6*a* shows a variant of the second embodiment of the safety and arming device according to the invention in its safety position.
Figure 6B:
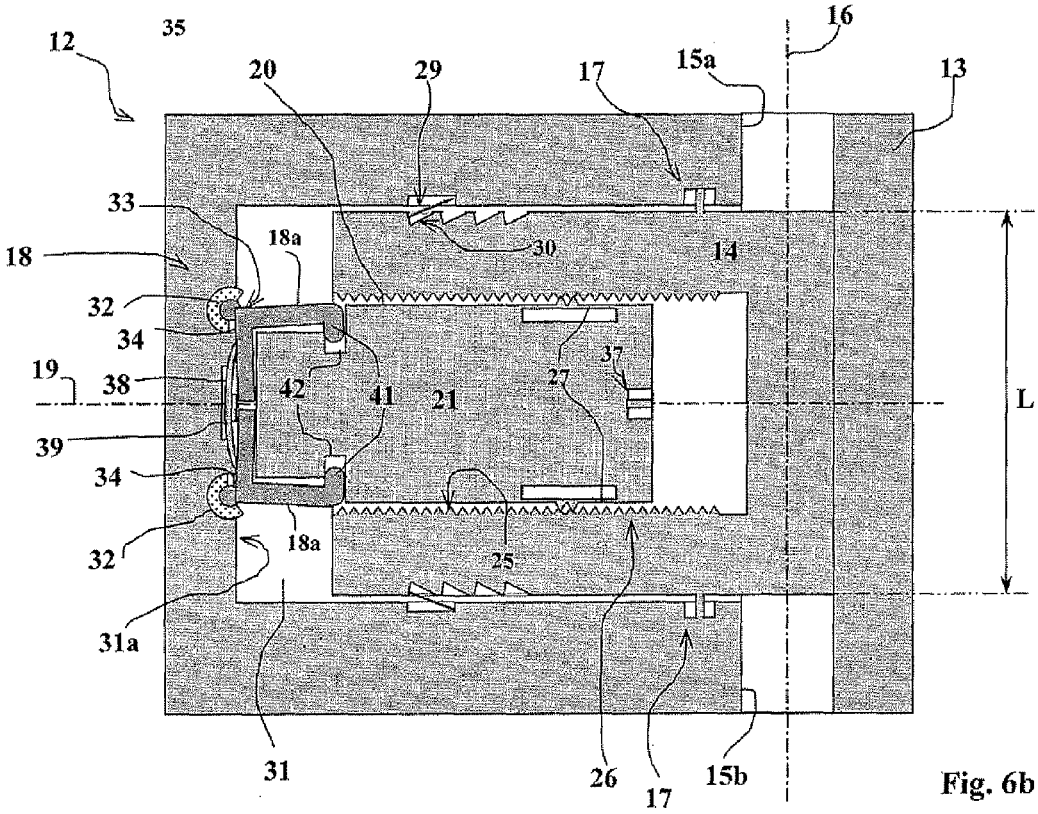
FIGS. 6*b* and 6*c* show this same variant during the different steps leading to its arming.
Figure 6C:
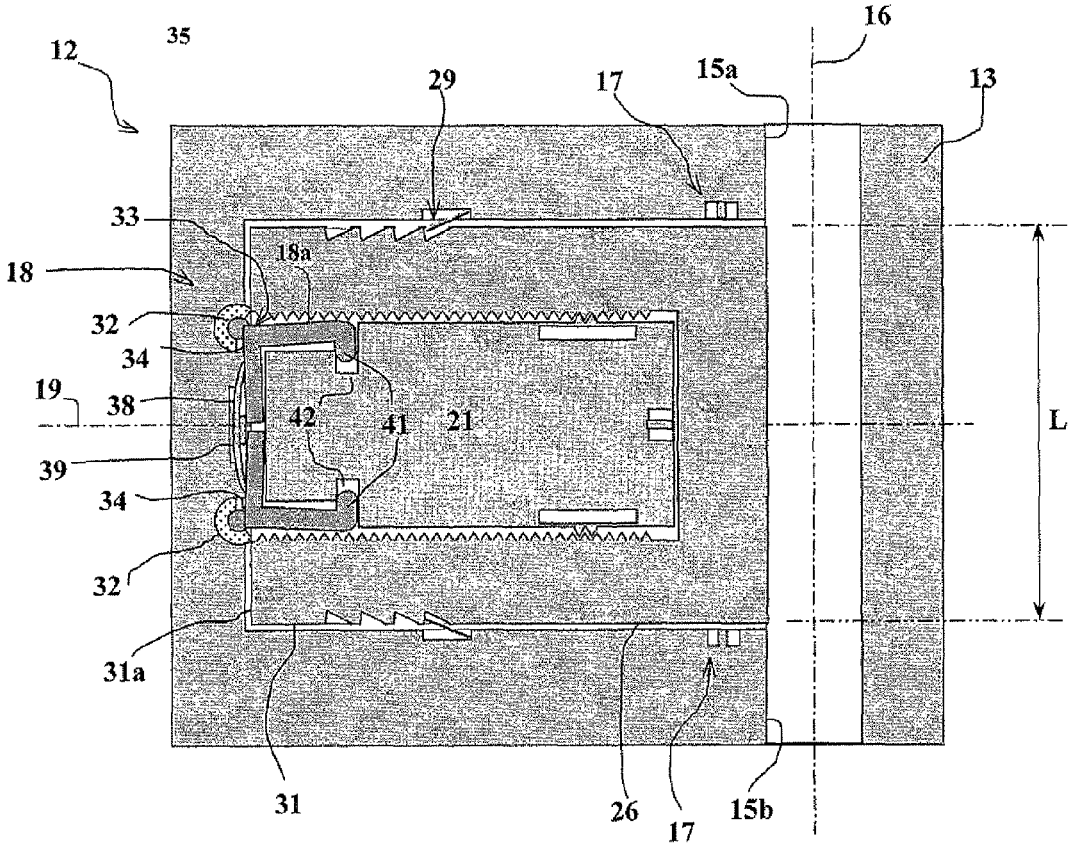

FIGS. 6*a* to 6*c* show a variant of this second embodiment.

FIG. 6*a* is analogous to FIG. 5*a* and shows the device in the safety position. FIGS. 6*b* and 6*c* respectively correspond to FIGS. 5*b* and 5*c* and show the device during different steps leading to its arming.

This variant only differs from the embodiment shown in FIGS. 5*a* to 5*c* in the specific shape of the second lock 18.

It is thus unnecessary for all the structure of the device to be described again since this is the same as for the second embodiment shown in FIGS. 5*a* to 5*c*. According to this variant, the lock still comprises two substantially L-shaped fingers 18*a*, but each finger 18*a* has a tooth 41 at its end that presses on a lateral edge of the counterweight 21 in the device's safety position (FIG. 6*a*). The tooth 41 is substantially perpendicular to the finger 18*a*, thus parallel to the prolongation 18*d* of each finger 18.

Such an arrangement reinforces the resistance of the lock to the acceleration constraints, thereby making the functioning of the device more reliable.

Indeed, since the teeth 41 of the two fingers 18*a* press on the counterweight 21, the centrifugal inertial stresses exerted on the shutter 14 during firing are not able to make the fingers 18*a* pivot around their joint 32. The locking of the shutter 14 is thus ensured during the full displacement of the counterweight 21.

The counterweight 21 alone is able to move under the effect of the centrifugal force. FIG. 6*b* shows this device after the full displacement of the counterweight 21, thus after the delay ensured by the braking means 25, 16, 17 but before the displacement of the shutter 14.

It can be noted that the counterweight 21 incorporates notches 42 on its lateral edges on which the teeth 41 press. These notches 42 receive the teeth 41 when the counterweight 21, at the end of its stroke of movement, causes the fingers 18*a* to swivel.

Once the teeth 41 are housed in the notches 42, the shutter 14 is unlocked. It is then able to adopt the armed position shown in FIG. 6*c*.

What is claimed is:

1. A micro-machined or micro-engraved safety and arming device for a pyrotechnic train of a projectile to which an axial spin motion is imparted during firing, said device comprising a substrate onto which a shutter to interrupt said pyrotechnic train is deposited that is mobile in translation on said substrate, said device where said shutter to interrupt the train being held immobile by at least two locks, a first lock or axial acceleration lock that is released further to the application of the acceleration communicated to said projectile during firing and a second lock that is a centrifugal lock released further to the spinning of said projectile, wherein said second lock comprises at least one swiveling locking finger positioned between said substrate and said shutter, said finger being oriented in a direction parallel to the direction of movement of said shutter and incorporating a bearing surface against which said shutter presses in its locked position, said finger further incorporating a prolongation, and said device incorporating a counterweight arranged in a housing in said shutter and sliding under the effect of the centrifugal acceleration until coming into contact at the end of its stroke with said prolongation of said finger to cause the latter to swivel and thus release said second lock.

2. A safety and arming device according to claim 1, wherein said second lock incorporates two locking fingers symmetrical to one another and with respect to a median plane of said device parallel to the direction of movement of said shutter.

3. A safety and arming device according to claim 2, wherein said prolongation of each said two fingers extends inside said housing of said counterweight, said counterweight further incorporating inclined planes that cooperate with said prolongations of said two fingers to cause them to swivel.

4. A safety and arming device according to claim 2, wherein each of said two finger forms a right angle with its prolongation, said prolongation being near to the bottom of the cavity receiving said shutter on said substrate.

5. A safety and arming device according to claim 4, wherein each of said two fingers is linked to said substrate by a pivot-type joint that will be positioned at the angle separating said two fingers and its prolongation.

6. A safety and arming device according to claim 5, wherein each said joint is immobilized by breakable-type locking means that are broken by said shutter pressing on them.

7. A safety and arming device according to claim 5, wherein said device incorporates shock-absorbing means comprising a flexible tongue integral with said substrate and against which said prolongations of each of said two fingers press when pushed by said counterweight at the end of its stroke.

8. A safety and arming device according to claim 5, wherein each of said two fingers is provided with a tooth at its end that presses on said counterweight in a safety position of said device, said counterweight further incorporating notches in which the teeth are housed when the counterweight causes said two fingers to swivel.

9. A safety and arming device according to claim 4, wherein said device incorporates shock-absorbing means comprising a flexible tongue integral with said substrate and against which said prolongations of each of said two fingers press when pushed by said counterweight at the end of its stroke.

10. A safety and arming device according to claim 4, wherein each of said two fingers is provided with a tooth at its end that presses on said counterweight in a safety position of said device, said counterweight further incorporating notches in which the teeth are housed when the counterweight causes said two fingers to swivel.

* * * * *